United States Patent [19]

Ingle

[11] Patent Number: 4,713,030

[45] Date of Patent: Dec. 15, 1987

[54] MARINE CRAFT

[76] Inventor: John W. Ingle, 85 Cynthia Road, Toronto, Ontario, Canada, M6N 2P8

[21] Appl. No.: 8,146

[22] Filed: Jan. 22, 1987

Related U.S. Application Data

[63] Continuation-in-part of Ser. No. 598,980, Apr. 11, 1984, which is a continuation of Ser. No. 744,527, Jun. 14, 1985, abandoned.

[51] Int. Cl.[4] ..... B63H 1/38

[52] U.S. Cl. ..... 440/99; 114/350

[58] Field of Search ..... 440/98, 100, 93; 114/349, 350, 197; 280/206; 308/DIG. 1; 416/84

[56] References Cited

U.S. PATENT DOCUMENTS

| | | | |
|---|---|---|---|
| 412,982 | 10/1889 | Schenck | 114/197 |
| 731,394 | 6/1903 | Terwilleger | 114/350 |
| 2,309,875 | 2/1943 | Thompson | 440/100 |
| 2,326,400 | 8/1943 | Shuhart | 440/99 |
| 4,365,579 | 12/1982 | Perez | 114/349 |

FOREIGN PATENT DOCUMENTS

| | | | |
|---|---|---|---|
| 156016 | 3/1903 | Fed. Rep. of Germany . | |
| 151028 | 5/1903 | Fed. Rep. of Germany . | |
| 3004823 | 8/1981 | Fed. Rep. of Germany . | |
| 1053385 | 3/1952 | France . | |
| 1255440 | 1/1960 | France . | |
| 1403487 | 5/1965 | France . | |
| 983142 | 2/1965 | United Kingdom | 308/DIG. 1 |

*Primary Examiner*—Joseph F. Peters, Jr.
*Assistant Examiner*—Edwin L. Swinehart
*Attorney, Agent, or Firm*—George A. Rolston

[57] ABSTRACT

A marine craft comprises an outer hull of completely spherical shape, an inner hull of hemispherical shape, universal bearings between the inner hull and outer hull supporting the inner structure in the outer hull and permitting universal movement, and a mass in the inner hull biassing it into a reference position. A plurality of spaced apart groups of four fins are provided on the exterior of the outer hull to procure propulsion of the craft along the surface of the water on rotation of the outer hull about any diametric axis. The four fins of each group are joined to each other in a generally cruciform configuration. The fins of any one such group are coplanar with a first pair of mutually perpendicular diametric axes of the outer hull while the fins of another one of such groups are coplanar with a different pair of mutually perpendicular diametric axes.

5 Claims, 4 Drawing Figures

MARINE CRAFT

This application is a continuation-in-part of application Ser. No. 598,980, filed Apr. 11, 1984 entitled MARINE CRAFT, inventor John W. Ingle, now abandoned, which application is a continuation of application Ser. No. 744,527, filed June 14, 1985 now abandoned.

The invention relates to a marine craft, and in particular to an emergency all-weather life-saving craft such as a lifeboat.

BACKGROUND OF THE INVENTION

The design of marine craft, conventionally employs a hull which is designed to ride in the water in only one orientation, that is to say with its keel or center portion of the hull lowermost, and with the sides of the hull projecting above the water. The crew, passengers, cargo, etc. are intended to be contained within the hull.

In smaller craft the hull is simply open, and in larger craft a deck conventionally covers in the open upper portion of the hull.

Structure within the interior of the hull is normally fixed to the hull. When the hull rolls, any structure attached within the hull will, of course, roll with it. The design of ships lifeboats and other rescue craft has followed these lines. As a result, passengers and crew attempting to leave a vessel in distress are required to climb into what is essentially an open boat, which is then lowered by ropes into rough water immediately alongside the rolling vessel, after which the ropes are cast off, and an attempt is made to propel the lifeboat either with oars or under power away from the side of the sinking vessel.

It is well known that this is a most hazardous undertaking, and that it is almost never practiced in rough weather, and that in all probability more lives are lost attempting to leave a vessel than would be lost if they remained on board. Other forms of life-saving craft involve life rafts, and inflatable craft. Life rafts are generally speaking unsuitable since persons on them are totally exposed to the elements.

In addition, in rough weather a life raft may tumble over and over, and it is almost impossible for a person to maintain his grasp in those circumstances. Inflatable rafts are provided having complex designs incorporating inflatable canopies or hoods. These inflatable craft do not appear to be entirely satisfactory. Experience of persons attempting to use them in rough weather indicates that they too are easily overturned. In addition, the rough handling likely to be experienced during an escape from a sinking vessel in rough weather is likely to puncture the craft or damage the fabric of such inflatable craft rendering them useless.

Lifeboats may be constructed with decks to enclose the hull but this is generally impractical. Such craft must be small enough to be carried on a larger vessel, and launched from it.

Hull design conventionally requires an outer skin, and an inner frame work of ribs, which support the outer skin. Where the hull is to be totally enclosed with a deck, the construction of the deck will have to follow the same general principle, that is to say, it will have to incorporate an outer skin, and ribs extending across its interior.

This will severely restrict the space available in the interior of the hull, and the seating accommodation will be limited.

Even when fully decked-in, such a lifeboat could be capsized in rough weather, and while it might continue to float, it would be unmanageable and endanger the occupants.

Some of these considerations also apply to craft other than life saving or emergency craft.

Sports and pleasure craft may well utilize aspects of the invention with advantage.

BRIEF SUMMARY OF THE INVENTION

With a view to overcoming these disadvantages, and providing a marine craft suitable both for life-saving purposes and many other uses, the invention comprises an outer hull of completely spherical shape, and an inner load carrying structure of hemispherical shape, and universal bearing means between such inner structure and such outer hull, supporting such inner structure within such outer hull, and permitting universal movement of such inner structure relative to such outer hull, and mass means in said inner structure, biasing the same into a predetermined reference position regardless of movement of such outer hull.

More particularly, the invention seeks to provide a craft having the foregoing advantages, including motor means on said inner structure, engageable with and disengageable from such outer hull, whereby such outer hull may be rotated relative to such inner hull along any selected axis of such inner structure, and means for operating such motor means, and means for steering such outer hull.

More particularly, the invention seeks to provide a craft having foregoing advantages incorporating multidirectional fins on the exterior of such outer hull, whereby rotation of such outer hull may cause propulsion of such craft along the surface of the water in any desired direction.

More particularly, the invention seeks to provide such a craft having hatchway means for entrance through said outer hull into such inner structure, and cover means for sealing such hatchway against the entrance of water.

More particularly, the invention seeks to provide such a craft having air valve means, and closure means therefor, in such outer hull, whereby air may be admitted, and water excluded.

More particularly, the invention seeks to provide such a craft having the foregoing advantages including gas storage means in such inner structure, for carrying a quantity of a breathable gas.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
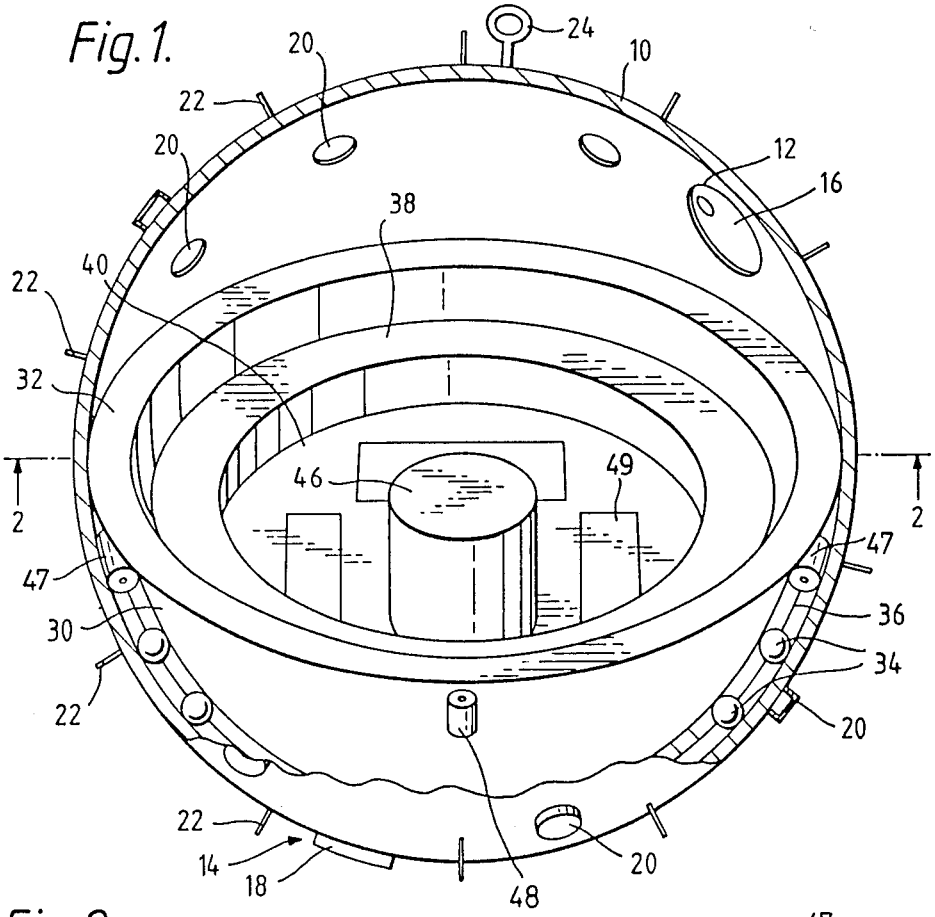
FIG. 1 is a perspective illustration partially cut away, showing the marine craft according to the invention.

As best shown in FIG. 1, the marine craft according to the invention comprises an outer hull 10 which is completely spherical in shape. The hull 10 has in this embodiment two access ports or hatches 12 and 14, located diametrically opposite to one another. Each of such ports 12 and 14 is provided with a hatch cover 16, 18, which is preferably swingably mounted on the hull, and may be fastened by any suitable locking or fastening means of a type well known in the art (not shown).

Such hatches will, of course, incorporate suitable sealing means to prevent entry of water.

The hull 10 is also provided with a plurality of air valves 20, located at spaced apart points. The air valves 20 incorporate suitable closure means (not shown) to prevent the entry of water. Valves 20 may be opened to permit entry of air, for occupants within the hull, when hull 10 is reasonably stable.

The hull 10 is also provided with a plurality of fins or vanes 22 (not shown in FIG. 2), the purpose of which will be described below.

The hull 10 may also be provided with a plurality of lifting eyes 24 fastened to the exterior of the hull, by means of which the entire structure may be lifted out of the water, or lowered into it, as desired.

Within the outer hull 10, is located an inner hull or structure indicated generally as 30. The inner hull 30 may typically be of hemispherical shape, and has an upper peripheral rim or flange 32, in this embodiment, and defines a predetermined spacing between itself and the interior of the outer hull 10. Within this spacing there is provided any suitable form of universal bearing means, by means of which the inner hull 30 may rest upon the interior of the outer hull 10.

In the embodiment shown, such universal means comprise a plurality of ballbearings 34, which are preferably suitably located by means of a bearing cage 36. Typically, this cage will be of generally hemispherical shape, and lie between the inner hull 30 and the outer hull 10, its purpose being simply to locate the ballbearings.

By this means, the inner hull 30, and the outer hull 10, are rendered rotatable relative to one another in any axis, without any restriction.

The inner hull 30 is provided with, in this embodiment, seats consisting essentially of a continuous circular bench 38, and a floor 40. Beneath the floor 40, there will be located in a typical example, electrical storage battery 42, and gas storage means 44.

Figure 2:
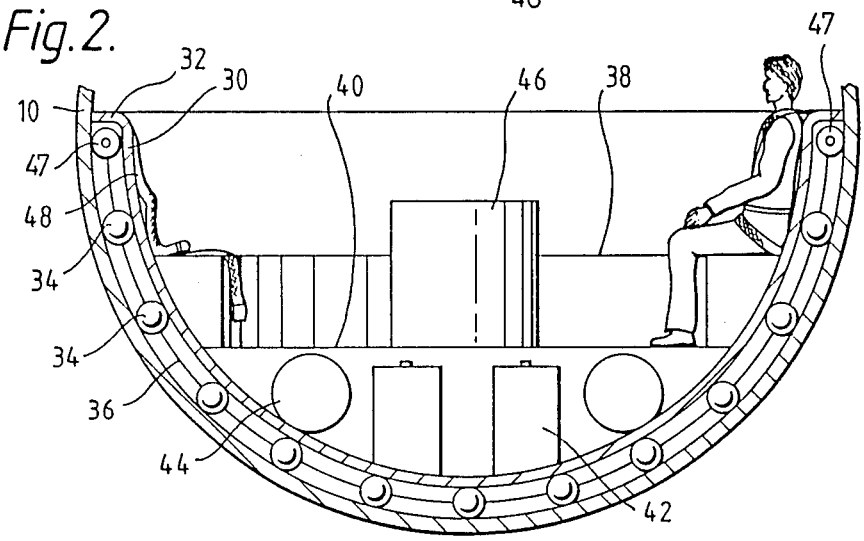
FIG. 2 is a section through the lower half of the marine craft of FIG. 1, along the line 2—2.

A central console 46 may also be provided for storage of food, radio equipment, flares and the like depending upon the design and usage of the particular craft. Preferably, the bench 38 may also be provided with suitable personal harnesses 48, which may be used to strap in occupants as shown in FIG. 2.

In order to provide a certain minimum degree of mobility, a drive transmission means is preferably provided on the inner hull 30, and engageable and disengageable with the outer hull 10.

In this embodiment such a drive transmission means is shown generally as a pair of electrical motors 47 and 51, mounted between the inner hull 30 and the outer hull 10. These motors will incorporate any suitable releasable drive transmission means (not shown) by means of which the interior of the outer hull may be engaged, typically frictionally engaged, and rotated relative to the inner hull by means of the motors.

In order to provide for some degree of directional control, a third directional control motor and transmission means are preferably provided in the form of the motor 48.

By this means the craft may be propelled to a certain degree in a predetermined direction, thereby giving it some mobility.

Typically, such motors 47 and 48 will be operated by electrical power supplied by batteries 42.

It will, of course, be appreciated, however, that it is equally possible to provide a manual form of drive transmission, operable by the occupants within the interior of the craft, and the invention is not therefore limited to motors, batteries and the like or indeed to any particular power source.

It will, of course, be appreciated that the interior of the outer hull 10 must be substantially completely smooth and regular and free of obstructions. In this way, the ballbearings 34 will be free to roll around the interior of the hull 10, while being retained in position by means of the cage 36 and the inner hull 30. Thus, the design of the hatch covers and ports and air valves will all be such that they do not intrude into the interior of the outer hull 10, but present an essentially smooth regular surface all over such interior to provide a smooth rolling surface for engagement of such ballbearings.

It is particularly useful if the outer hull 10 is formed of transparent plastic material, or is provided with a plurality of windows all over its surface, so that the occupants within the hull may easily see out, no matter what position the inner hull is relative to the outer hull.

The outer hull will also incorporate some form of radio antenna (not shown) and radar reflector (not shown) such as are well known in the art, and these may be incorporated for example in the fins 22, or any other portion of the structure, or may be provided separately, and may be of such a type that they are telescopic or retractable, the details of which are omitted for the sake of clarity.

Suitable trap doors 49 may be provided in the floor, and under the bench 38 if desired, for access to storage areas of the inner hull.

By use of the invention it will be noted, therefore, that the inner hull 30 is provided with a biasing mass constituted in this embodiment by for example the space beneath the floor which is occupied by the gas storage, and batteries. This being the lowermost point of the inner hull 30, it will be apparent that this mass will bias the inner hull so that it always adopts a reference position due to gravity regardless of rotational movement of the outer hull relative to the inner hull.

Clearly, there will be some slight time lag, and the inner hull 30 will pitch and roll to some degree. Experiments, however, have shown that an unusual degree of stability can be achieved by the use of the invention, giving the occupants of the inner hull 30 a surprising degree of comfort and safety under conditions which would be impossible for any other craft.

It will be appreciated also that other forms of bearing means may be used other than the ballbearing shown. A fluid or liquid bearing medium will function in essentially the same way as the ballbearings.

The term "universal bearing means" is intended to encompass all such various different systems whereby the inner hull may be supported within the outer hull, whether disclosed herein in detail or not.

It will also be appreciated that a marine craft of the type described is not limited exclusively to life saving or emergency situations. The principles of the invention are equally applicable, for example, to recreational craft, such as for example sport boats, observation boats and the like and also to model craft, unmanned marine research craft, robotic marine craft and even toys.

Figure 3:
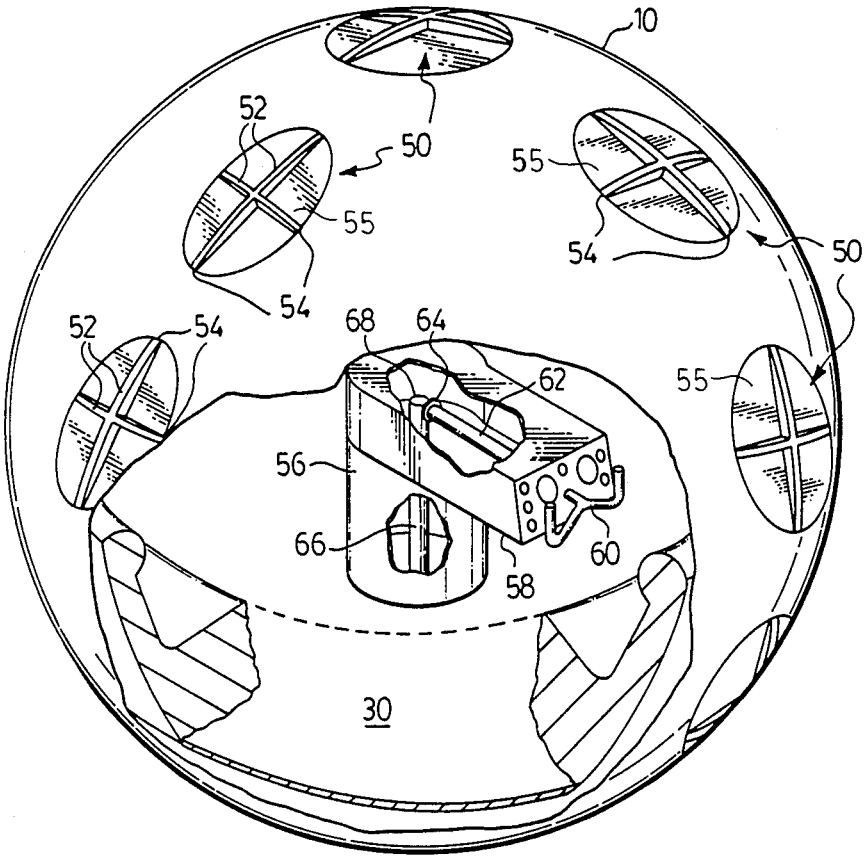
FIG. 3 is a perspective of a modified form of marine craft partially cut away, and, FIG. 4 is a perpsective of the drive mechanism of the marine craft of FIG. 3.
Figure 4:
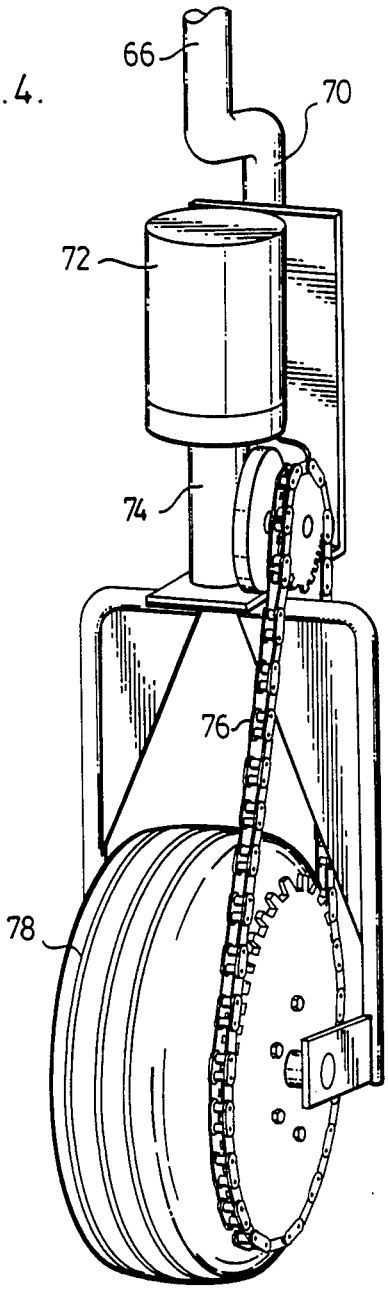

A modified form of marine craft in accordance with the invention is shown in FIGS. 3 and 4. The same outer hull 10, and inner hull 30 are provided, supported on suitable universal bearing means (not shown).

In this embodiment of the invention, groups 50 of multidirectional drive fins 50 are provided at spaced points on the exterior of the outer hull 10. The groups 50 are formed of four plates or fins 52, which are usefully of equal length. Each fin 52 has a root end and a tip end, and a tapered profile. The fins 52 are joined at their root ends to one another at right angles to form a generally cruciform shape.

Each of the fins or plates 52 is formed with tapering tip ends 54. The faces of the four fins or plates 52 thus extend outwardly from the outer hull and lie in planes which include diametric axes of said outer hull, so as to effectively engage the water in the manner of paddles.

The intersection point of each of the fins or plates 52 is the highest point of such plates, and they reduce in height progressively towards their ends so as to merge smoothly with the contour of the outer hull 10, at their ends. At the location of each group 50 of fins 52, the surface of the outer hull has generally circular depressions 55.

In this way, each of the fins 52 is mutually supporting the other fins at their centre point, at its point of maximum stress.

The fins 50 are thus able to engage the water, no matter what axis or direction the outer hull 52 is rotating.

Each fin 52 usefully has a curved profile so that its outer surface is disposed so as to be co-spherical with the outer surface of the outer hull 10. In this way, the fins 52 offer minimum obstruction to the rotation of the outer hull 10 during launching for example, and by their mutually supporting structure, are thus highly resistant to bending, crushing or other damage.

In addition, in this form of the invention, the inner hull 30 is provided with a modified form of central console 56, having a control module 58 extending horizontally to one side.

The control module 58 is provided with various switches and dials, for operation of the various support systems in the marine craft. In addition, however, it is also provided with a manually operable steering wheel 60, which is located at the free end of the module 58, adjacent a suitable seating location in the inner hull 30.

The horizontal steering shaft 62 extends from the wheel 60 and terminates typically in a bevel gear 64.

A vertical central steering shaft 66 extends down the centre of the console 56. It has a further bevel gear 68 at its upper end meshing with bevel gear 64. In this way, rotation of wheel 60 will procure rotation of shaft 66.

As best shown in FIG. 4, the lower end of shaft 66 extends downwardly below inner hull 30 into the space between inner hull 30 and the outer hull 10.

It has a generally L-shaped crank portion 70, which extends parallel to shaft 66. On crank portion 70, there is mounted a reversible drive motor 72, a reduction gear box 74, and a drive chain 76 and sprocket.

A drive wheel 78 is mounted below the motor and gear box 72 and 74 and is driven by the drive chain 76.

By operation of suitable controls the motor may be operated either in forward or reverse directions, thereby driving the wheel 78 either forwardly or backwardly.

By operation of the steering wheel, the steering column 66 can be rotated through 360°.

In this way, the craft can be driven by rotating the outer hull 10 in any desired direction or axis relative to the inner hull 30.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A marine craft comprising:

an outer hull of completely spherical shape;

an inner load-carrying structure of hemispherical shape;

universal bearing means between said inner structure and said outer hull supporting said inner structure within said outer hull and permitting universal movement of said inner structure relative to said outer hull;

mass means in said inner structure, biasing the same into a predetermined reference position;

drive motor means on said inner structure, engageable with and disengageable from said outer hull, whereby said outer hull may be rotated relative to said inner hull about a selected diametric axis of said inner structure, and means for operating said drive motor means;

a plurality of groups of fins on the exterior of said outer hull, each of said groups comprising four planar fins each said fin defining a root and a tip and tapering from said root to said tip, said four fins in each said group joining one another at their roots at a central junction in a generally cruciform configuration and extending radially away from said central junction, with adjacent said fins in said group being arranged at right angles to one another, said groups of fins being located at spaced apart positions over said outer hull, said fins being disposed in planes which include diametric axes of said outer hull whereby rotation of said outer hull about any selected diametric axis may cause some said fins to engage the water and procure propulsion of said craft along the surface of the water.

2. A marine craft as claimed in claim 1 having hatchway means for entrance through said outer hull into such inner structure, and cover means for sealing said hatchway against the entry of water.

3. A marine craft as claimed in claim 1 wherein said universal bearing means comprises a plurality of ball bearings and spacer means therefor.

4. A marine craft as claimed in claim 1, wherein said tip of each of said fins merges with the contours of said outer hull, each said fin defining faces on opposite sides for engaging water and propelling said craft along the surface of the water by rotation of said outer hull about a selected diametric axis.

5. A marine craft as claimed in claim 4 and in which each said group of fins is formed on a generally circular depression in said outer hull.

* * * * *